US012760229B2

(12) United States Patent
Cuoq et al.

(10) Patent No.: US 12,760,229 B2
(45) Date of Patent: Oct. 13, 2026

(54) METHODS FOR PROCESSING PYROLYSIS OIL

(71) Applicant: SABIC Global Technologies B.V., Bergen op Zoom (NL)

(72) Inventors: Fabrice Cuoq, Maaseik (BE); Martjin Marcel Margaret Frissen, Born (NL); Carlo Jozef Maria Geijselaers, Eindhoven (NL); Anthoni Wouter Van Zijl, Eindhoven (NL)

(73) Assignee: SABIC Global Technologies B.V., Bergen op Zoom (NL)

( * ) Notice: Subject to any disclaimer, the term of this patent is extended or adjusted under 35 U.S.C. 154(b) by 222 days.

(21) Appl. No.: 18/721,148

(22) PCT Filed: Dec. 14, 2022

(86) PCT No.: PCT/EP2022/085965
§ 371 (c)(1),
(2) Date: Jun. 17, 2024

(87) PCT Pub. No.: WO2023/117650
PCT Pub. Date: Jun. 29, 2023

(65) Prior Publication Data

US 2025/0051660 A1 Feb. 13, 2025

Related U.S. Application Data

(60) Provisional application No. 63/291,938, filed on Dec. 20, 2021.

(51) Int. Cl.
*C10G 55/02* (2006.01)
*C10B 53/07* (2006.01)

(52) U.S. Cl.
CPC ..... *C10G 55/02* (2013.01); *C10B 53/07* (2013.01); *C10G 2300/1003* (2013.01); *C10G 2400/20* (2013.01); *C10G 2400/22* (2013.01)

(58) Field of Classification Search
CPC ..... C10B 53/07; C10G 1/002; C10G 1/10; C10G 55/04; C10G 25/003; C10G 9/00; C10G 55/02; C10G 2300/1003; C10G 2400/22; C10G 2400/20; C10G 2300/201
See application file for complete search history.

(56) References Cited

U.S. PATENT DOCUMENTS 6,638,347 B2 10/2003 El-Shoubary et al.

FOREIGN PATENT DOCUMENTS

| | | | |
|---|---|---|---|
| CN | 104209090 | A | 12/2014 |
| EP | 1888226 | B8 | 9/2011 |
| EP | 3907267 | A1 | 11/2021 |
| JP | H10231486 | A | 9/1998 |

(Continued)

OTHER PUBLICATIONS

Bleaching clays. https://epengineeredclays.com/#bleaching-clays. Retrieved Jun. 17, 2024, 6 pages.

(Continued)

*Primary Examiner* — Vishal V Vasisth
(74) *Attorney, Agent, or Firm* — Norton Rose Fulbright US LLP

(57) ABSTRACT

Systems and methods for removing contaminants from pyrolysis oil are disclosed. The removal of the contaminants, such as chlorides, involves mixing the pyrolysis oil with char, in a mixing unit, wherein the char was formed as a by-product of the pyrolysis of plastic to produce pyoil.

18 Claims, 1 Drawing Sheet

(56) References Cited

FOREIGN PATENT DOCUMENTS

| | | | |
|---|---|---|---|
| JP | 2005111470 | A | 4/2005 |
| JP | 2014036940 | A | 2/2014 |
| TW | 200839003 | A | 10/2008 |
| WO | WO2017073631 | A1 | 5/2017 |
| WO | WO2021255591 | A2 | 12/2021 |

OTHER PUBLICATIONS

Edible Oil Purification with ColorSorb™ XFP21. https://www.jacobi.net/edible-oil-purification/. Retrieved Jun. 17, 2024, 4 pages.
Edible oil purification. https://activated-carbon.com/edible-oil-purification/. Retrieved Jun. 17, 2024, 4 pages.
International Search Report and Written Opinion from PCT/EP2022/085965 dated Mar. 16, 2023, 12 pages.
Silica Hydrogel and its Use in Edible Oil Processing. https://lipidlibrary.aocs.org/edible-oil-processing/silica-hydrogel-and-its-use-in-edible-oil-processing. Retrieved Jun. 17, 2024, 14 pages.
TRISYL® Silica for Edible Oil Refining. https://grace.com/food-and-beverage/en-US/edible-oil-refining-aids. Retrieved Jun. 17, 2024, 6 pages.
U.S. Appl. No. 63/039,868, filed Jun. 16, 2020, 43 pages.

METHODS FOR PROCESSING PYROLYSIS OIL

CROSS REFERENCE TO RELATED APPLICATIONS

This application is a national phase application under 35 U.S.C. § 371 of International Application No. PCT/EP2022/085965 filed Dec. 14, 2022, which claims priority to U.S. Provisional Patent Application No. 63/291,938 filed Dec. 20, 2021. The entire contents of each of the above-referenced disclosures is specifically incorporated by reference herein without disclaimer.

FIELD OF INVENTION

The present disclosure generally relates to systems and methods of processing pyrolysis oil (pyoil). More specifically, the present disclosure relates to system and methods for removing contaminants from pyoil using char produced by pyrolysis of plastic.

BACKGROUND OF THE INVENTION

Plastics are ubiquitous materials. Tons of plastics are produced every day and waste plastics have created serious environmental challenges because they are resistant to decomposition. Thus, it is important to the environment to find ways to reuse and/or recycle waste plastics.

Pyrolysis of plastics (e.g., mixed waste plastics) is a process that involves subjecting the plastics to high temperature such that the plastic decomposes to form pyoil. Pyoil can be used as a liquid fuel or further processed to form other chemicals. However, pyoil produced from mixed plastics generally contains a substantial amount of contaminants such as chlorides. These chlorides are detrimental to equipment used in further processing of the pyoil. Specifically, the chlorides can contribute to fouling and corrosion of equipment when the pyoil is cracked.

One method of dealing with the contaminants (e.g., chlorides) in pyoil is to dilute it with naphtha at a very high dilution ratio so as to make the resultant mixture suitable for cracking in a steam cracker. The dilution decreases the effects of the contaminants (fouling, corrosion, etc.). Another method for dealing with chlorides in the pyoil is to hydrotreat the pyrolysis oil to convert chlorinates into hydrochloric acid (HCL). Depending on the process employed, removal of chlorides can be costly, difficult, and time-consuming.

BRIEF SUMMARY OF THE INVENTION

The current inventors have discovered, and disclose herein, a process for processing pyoil to remove contaminants. Embodiments of the disclosure involve removing contaminants from pyoil with a material—char—that is generated by the production of pyoil itself.

Embodiments of the disclosure include a method of processing pyrolysis oil. The method comprises mixing the pyrolysis oil with char derived from pyrolysis of plastic and thereby remove at least some material from the pyrolysis oil.

Embodiments of the disclosure include a method of processing pyrolysis oil. The method comprises mixing the pyrolysis oil with char derived from pyrolysis of plastic and thereby remove at least some materials comprising chlorine from the pyrolysis oil to form a purified pyrolysis oil. The method further includes cracking the purified pyrolysis oil to produce one or more olefins.

Embodiments of the disclosure include a method of processing pyrolysis oil. The method comprises pyrolyzing plastic to form pyrolysis oil and char. The method further comprises mixing the pyrolysis oil with char formed from the pyrolyzing of the plastic or from pyrolyzing of other plastic to remove at least some chloride compounds from the pyrolysis oil to form a purified pyrolysis oil and used char. The method also comprises separating the used char from the purified pyrolysis oil and cracking the purified pyrolysis oil to produce one or more olefins.

The following includes definitions of various terms and phrases used throughout this specification.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

For the purposes of this disclosure, "X, Y, and/or Z" can be construed as X only, Y only, Z only, or any combination of two or more items X, Y, and Z (e.g., XYZ, XY, XZ, YZ).

The terms "wt. %", "vol. %" or "mol. %" refer to a weight, volume, or molar percentage of a component, respectively, based on the total weight, the total volume, or the total moles of material that includes the component. In a non-limiting example, 10 moles of component in 100 moles of the material is 10 mol. % of component.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, include any measurable decrease or complete inhibition to achieve a desired result.

The term "effective," as that term is used in the specification and/or claims, means adequate to accomplish a desired, expected, or intended result.

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

The term "primarily," as that term is used in the specification and/or claims, means greater than any of 50 wt. %, 50 mol. %, and 50 vol. %. For example, "primarily" may include 50.1 wt. % to 100 wt. % and all values and ranges there between, 50.1 mol. % to 100 mol. % and all values and ranges there between, or 50.1 vol. % to 100 vol. % and all values and ranges there between.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

For a more complete understanding, reference is now made to the following descriptions taken in conjunction with the accompanying drawings, in which.

DETAILED DESCRIPTION OF THE INVENTION

Pyoil derived from pyrolysis of plastics is often contaminated with chloride compounds. The presence of these chloride compounds limits how the pyoil can be further processed because of the effect of the chloride compounds on processing equipment. The present disclosure provides a solution to at least some of these problems. The solution, according to embodiments of the disclosure, is premised on a method of processing pyoil that includes purifying the pyoil with char that is generated in the pyrolysis process that forms pyoil. The purified pyoil produced by the purifying step can be used in a cracking process to produce high value chemicals such as olefins, including light olefins ($C_2$ to $C_4$ olefins), $C_5$ olefins, and BTX (benzene, toluene, and xylene). These and other non-limiting aspects of the present disclosure are discussed in further detail in the following sections.

System for Processing Pyoil

Figure 1:
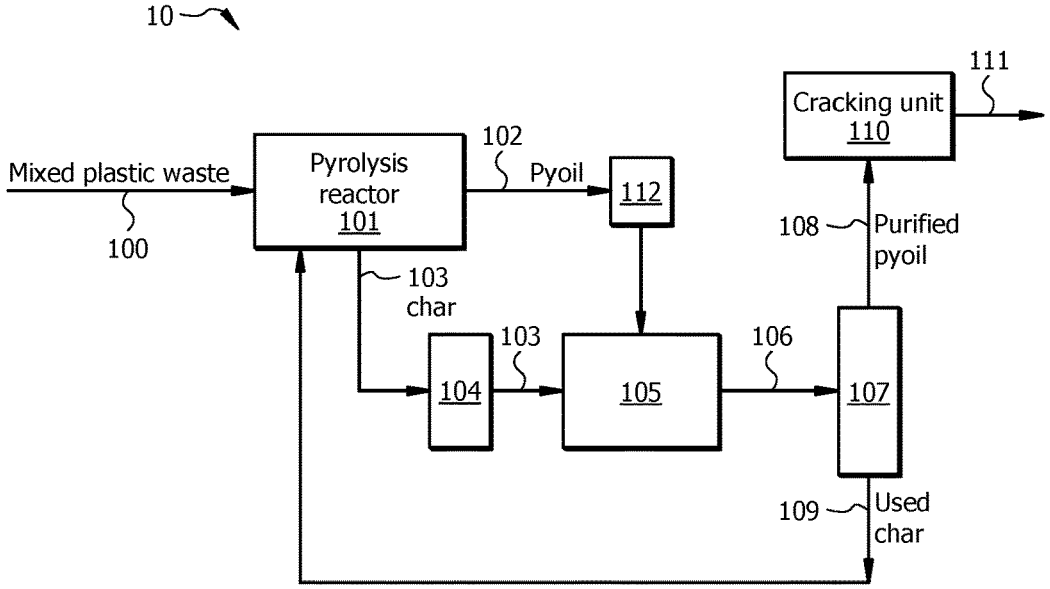
FIG. 1 shows a system for processing pyoil, according to embodiments of the disclosure.

In embodiments of the disclosure, the disclosed system can include a pyrolysis reactor, a storage unit for char, a tank, a mixing unit, a separation unit, and a cracking unit. According to embodiments of the disclosure, the system is configured to facilitate production of high value chemicals from pyoil without the negative effects of chlorides on the process. FIG. 1 shows system 10 for processing pyoil, according to embodiments of the disclosure.

According to embodiments of the disclosure, system 10 includes pyrolysis reactor 101, which is configured to subject mixed waste plastic 100 to pyrolysis to produce pyrolysis oil 102 and char 103. In embodiments of the disclosure, pyrolysis reactor 101 is in fluid communication with tank 112 so that pyrolysis oil 102 can be flowed to tank 112 for storage and cooling. Tank 112, according to embodiments of the disclosure is in fluid communication with mixing unit 105 so that after pyrolysis oil 102 is cooled to a desired temperature it can be flowed from tank 112 to mixing unit 105.

In embodiments of the disclosure, system 10 is adapted to transport char 103 to storage unit 104. Char 103, in embodiments of the disclosure, is stored in storage unit 104. Char 103, according to embodiments of the disclosure, is cooled in storage unit 104. When char 103 is at a desired temperature, according to embodiments of the disclosure, it is used to remove chloride compounds from pyrolysis oil 102 by mixing char 103 with pyrolysis oil 102 in mixing unit 105. According to embodiments of the disclosure, mixing unit 105 comprises one or more of the following: a spin contactor, a fluidized bed tank reactor, and a stirred tank reactor. It should be noted that in embodiments of the disclosure, instead of or in addition to tank 112 and storage unit 104, system 10 can include coolers for cooling pyrolysis oil 102 and/or char 103 before they are mixed in mixing unit 105.

In embodiments of the disclosure, mixing unit 105 is in fluid communication with separation unit 107 such that mixture 106 (which comprises used char and purified pyrolysis oil) can be flowed to separation unit 107. According to embodiments of the disclosure, separation unit 107 is configured to separate mixture 106 to produce purified pyrolysis oil 108 and used char 109. In embodiments of the disclosure, separation unit 107 comprises one or more of the following: a decanting unit, a centrifuge, a cartridge filer, and a hydrocyclone. In embodiments of the disclosure, separation unit 107 is in fluid communication with cracking unit 110, which is configured to crack pyoil to form product stream 111, which comprises one or more olefins. According to embodiments of the disclosure, separation unit 107 is also in communication with pyrolysis reactor 101 such that used char can be transferred from separation unit 107 to pyrolysis reactor 101.

Method for Processing Pyoil

Figure 2:
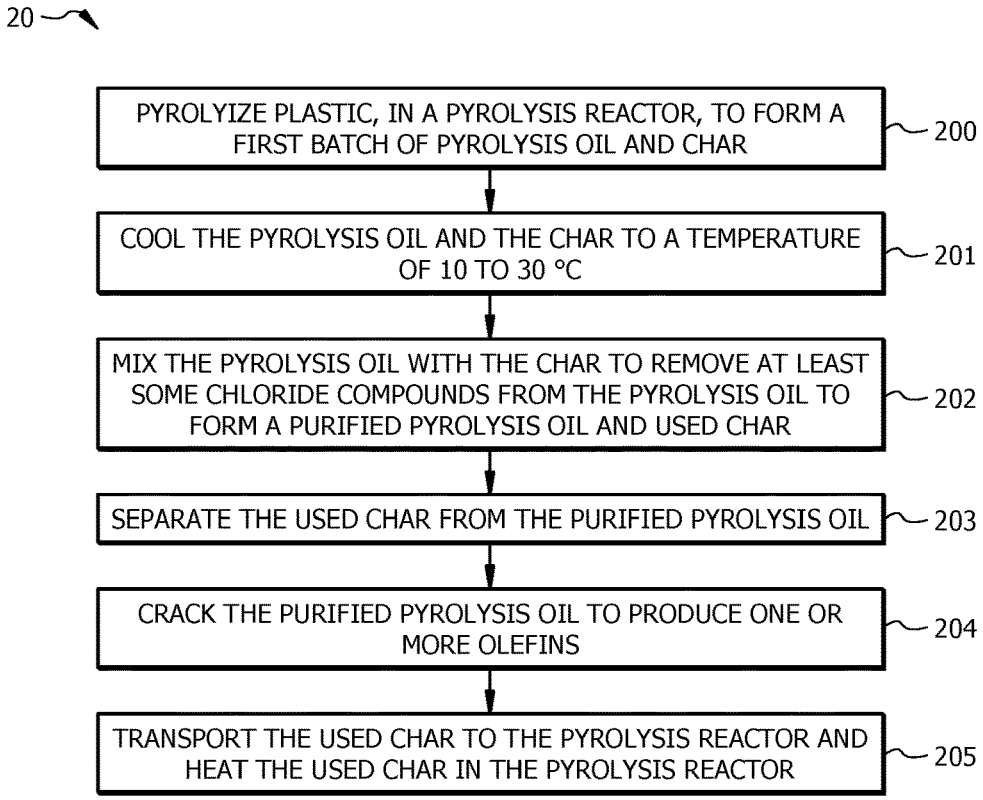
FIG. 2 shows a method of processing pyoil, according to embodiments of the disclosure.

FIG. 2 shows method 20 for processing pyoil, according to embodiments of the disclosure. Method 20 may be implemented by system 10, according to embodiments of the disclosure. It should be noted that method 20 can be carried out as a batch process, a continuous process, or a combination thereof, in embodiments of the disclosure.

According to embodiments of the disclosure, method 20 includes block 200, which involves pyrolyzing mixed waste plastic 100, in a pyrolysis reactor 101, to form pyrolysis oil 102 and char 103. In embodiments of the disclosure, method 20 involves, at block 201, flowing pyrolysis oil 102 to tank 112 and cooling pyrolysis oil 102 to a temperature of 10 to 30° C. within tank 112 and transferring char 103 to storage unit 104 and cooling char 103 in storage unit 104 to a temperature of 10 to 30° C. Alternatively or additionally, in embodiments of the disclosure, coolers can be used to cool pyrolysis oil 102 and char 103 to a temperature of 10 to 30° C. At block 202, according to embodiments of the disclosure, pyrolysis oil 102 and char 103 are mixed in mixing unit 105 such that char 103 adsorbs chlorine compounds from pyrolysis oil 102 to form mixture 106, which comprises purified pyoil and used char. The mixing at block 202, within mixing unit 105, according to embodiments of the disclosure, is carried out at a temperature in the range of 10 to 30° C. and all ranges and values there between, including a range of 10 to 12° C., 12 to 14° C., 14 to 16° C., 16 to 18° C., 18 to 20° C., 20 to 22° C., 22 to 24° C., 24 to 26° C., 26 to 28° C., and 28 to 30° C. The mixing at block 202, within mixing unit 105, according to embodiments of the disclosure, is carried out at a the pressure in the range of 0.5 to 5 bar and all ranges and values there between, include a range of 0.5 to 1.0 bar, 1.0 bar to 1.5 bar, 1.5 bar to 2.0 bar, 2.0 bar to 2.5 bar, 2.5 bar to 3.0 bar, 3.0 bar to 3.5 bar, 3.5 bar to 4.0 bar, 4.0 bar to 4.5 bar, and 4.5 bar to 5.0 bar. In embodiments of the disclosure, at least 20 wt. % of chlorides of pyrolysis oil 102 is removed to form purified pyrolysis oil 108. It should be noted that, in embodiments of the disclosure, char 103, which is mixed with pyrolysis oil 102 may be char formed from the same batch and/or a different batch of mixed waste plastic 100 that was pyrolyzed to form pyrolysis oil 102.

In embodiments of the disclosure, at block 203, mixture 106 is flowed to separation unit 107, where mixture 106 is separated to form purified pyrolysis oil 108 and used char 109. According to embodiments of the disclosure, the separating at block 203, by separation unit 107, includes one or more of the following: decantation, centrifugation, cartridge filtration, and hydrocycloning. At block 204, according to embodiments of the disclosure, purified pyoil 108 is flowed to cracking unit 110, where purified pyrolysis oil 108 is cracked to form one or more olefins, such as light olefins ($C_2$ to $C_4$ olefins), $C_5$ olefins, and BTX (benzene, toluene, and xylene).

In embodiments of the disclosure, used char 109 can be returned to pyrolysis reactor 101, where used char 109 is heated for decontamination and drying so as to facilitate proper discharge and waste handling of used char 109.

Although embodiments of the present disclosure have been described with reference to blocks of FIG. 2 it should be appreciated that operation of the present disclosure is not limited to the particular blocks and/or the particular order of the blocks illustrated in FIG. 2. Accordingly, embodiments of the disclosure may provide functionality as described herein using various blocks in a sequence different than that of FIG. 2.

The systems and processes described herein can also include various equipment that is not shown and is known to one of skill in the art of chemical processing. For example, some controllers, piping, computers, valves, pumps, heaters, thermocouples, pressure indicators, mixers, heat exchangers, and the like may not be shown.

As part of the disclosure of the present disclosure, specific examples are included below. The examples are for illustrative purposes only and are not intended to limit the disclosure. Those of ordinary skill in the art will readily recognize parameters that can be changed or modified to yield essentially the same results.

EXAMPLE

Removal of Chlorides from Pyoil with Char

Pyrolysis oil from a pyrolysis reactor was mixed with the char from the pyrolysis reactor in a 50 mL penicillin flask. Varied amounts of char and a fixed amount of pyoil (50 ml) were used. The penicillin flask was then closed and put on a rotative shaker (Heidolph Reax 5) at speed 5 for 24 hours (it is expected that shorter contact time will also work (minute to hours). After 24 hours, the mixture "char-pyoil" was filtered on a 0.2 μm PTFE syringe filter. The filtered pyoil was then analyzed for chloride concentration. The results of this analysis is shown in Table 1.

TABLE 1

Relative chloride removal function of chars concentration

| Chars concentration (% w) | Concentration Cl with UOP779 (ppm) | Chloride removed (% compared to blank) |
|---|---|---|
| 0.95 wt. % | 95 | 29 |
| 1.9 wt. % | 95 | 29 |
| 0 (blank experiment) | 133 | — |

Relative nitrogen removal function of chars concentration

| Chars concentration (% w) | Concentration N (ppm) | N removed (% compared to blank) |
|---|---|---|
| 0.95 wt. % | 1389 | 0 |
| 1.9 wt. % | 1269 | 7% |
| 0 (blank experiment) | 1361 | — |

Relative oxygen removal function of chars concentration

| Chars concentration (% w) | Concentration Total oxygen (ppm) | Total oxygen removed (% compared to blank) |
|---|---|---|
| 0.95 wt. % | N/A | N/A |
| 1.9 wt. % | 2180 | 5% |
| 0 (blank experiment) | 2300 | — |

Interestingly, the amount of char does not seem to impact removal rate of chloride, this is likely because the char has a very strong affinity with the chloride in pyrolysis oil or is only removing specific chloride species that have a very high affinity with the char. Based on these results, nitrogen and oxygen content are not impacted by the char addition.

Further, based on these results, it seems that the char can be mixed with pyrolysis oil, then recycled to the pyrolysis reactor to dry them and then processed as waste. This would then create an internal recycle stream within the plant and would not lead to production of wet chars that would be challenging to treat as waste due to high concentration of hydrocarbons.

In the context of the present invention, at least the following 16 embodiments are described. Embodiment 1 is a method of processing pyrolysis oil. The method includes mixing the pyrolysis oil with char derived from pyrolysis of plastic and thereby remove at least some material from the pyrolysis oil. Embodiment 2 is the method of embodiment 1, wherein the at least some material that is removed from the pyrolysis oil contains chlorine and the removing forms a purified pyrolysis oil and used char. Embodiment 3 is the method of any of embodiments 1 and 2, wherein at least 20 wt. % of chlorides in the pyrolysis oil is removed to form the purified pyrolysis oil. Embodiment 4 is the method of any of embodiments 1 to 3, further including separating the used char from the purified pyrolysis oil, and cracking the purified pyrolysis oil to produce one or more olefins. Embodiment 5 is the method of any of embodiments 1 to 4, wherein the separating is carried out by one or more of the following: decantation, centrifugation, cartridge filtration, and hydrocycloning. Embodiment 6 is the method of any of embodiments 1 to 5, further including transporting the used char to a pyrolysis reactor, and heating the used char in the pyrolysis reactor. Embodiment 7 is the method of any of embodiments 1 to 6, wherein the mixing is carried out by one or more of the following: a spin contactor, a fluidized bed tank reactor, and a stirred tank reactor. Embodiment 8 is the method of any of embodiments 1 to 7, wherein the mixing is carried out in a tank where the temperature within the tank is 10 to 30° C. Embodiment 9 is the method of any of embodiments 1 to 8, wherein the pressure within the tank is in a range of 0.5 to 5 bar.

Embodiment 10 is a method of processing pyrolysis oil. The method includes pyrolyzing plastic, in a pyrolysis reactor, to form pyrolysis oil and char. The method further includes mixing the pyrolysis oil with char formed from the pyrolyzing of the plastic or from pyrolyzing of other plastic to remove at least some chloride compounds from the pyrolysis oil and thereby form a purified pyrolysis oil and used char. The method still further includes separating the used char from the purified pyrolysis oil, and cracking the purified pyrolysis oil to produce one or more olefins. Embodiment 11 is the method of embodiment 10, wherein at least 20 wt. % of chloride compounds in the pyrolysis oil is removed to form the purified pyrolysis oil. Embodiment 12 is the method of any of embodiments 10 and 11, wherein the separating is carried out by one or more of the following: decantation, centrifugation, cartridge filtration, and hydrocycloning. Embodiment 13 is the method of any of embodiments 10 to 12, further including transporting the used char to a pyrolysis reactor, and heating the used char in the pyrolysis reactor. Embodiment 14 is the method of any of embodiments 10 to 13, wherein the mixing is carried out by one or more of the following: a spin contactor, a fluidized bed tank reactor, and a stirred tank reactor. Embodiment 15 is the method of any of embodiments 10 to 14, wherein the mixing is carried out in a tank where the temperature within the tank is 10 to 30° C. Embodiment 16 is the method of any of embodiments 10 to 15, wherein the pressure within the tank is in a range of 0.5 to 5 bar.

All embodiments described above and herein can be combined in any manner unless expressly excluded.

Although embodiments of the present application and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method of processing pyrolysis oil, the method comprising mixing the pyrolysis oil with at least a portion of char derived from pyrolysis of plastic, wherein the mixing causes the char to adsorb at least some chlorides from the pyrolysis oil to form a purified pyrolysis oil and used char.

2. The method of claim 1, wherein at least 20 wt. % of the chlorides in the pyrolysis oil is removed to form the purified pyrolysis oil.

3. The method of claim 1, further comprising:

separating the used char from the purified pyrolysis oil by one or more of the following:

decantation, centrifugation, cartridge filtration, and hydrocycloning; and cracking the purified pyrolysis oil to produce one or more olefins.

4. The method of claim 3, further comprising:

heating the used char in the pyrolysis reactor for decontamination and drying.

5. The method of claim 1, wherein the mixing is carried out by one or more of the following: a spin contactor, a fluidized bed tank reactor, and a stirred tank reactor.

6. The method of claim 1, wherein the mixing is carried out in a tank where the temperature within the tank is 10 to 30° C.

7. The method of claim 6, wherein the pressure within the tank is in a range of 0.5 to 5 bar.

8. A method of processing pyrolysis oil, the method comprising:

pyrolyzing plastic, in a pyrolysis reactor, to form pyrolysis oil and char;

mixing the pyrolysis oil with at least a portion of char formed from the pyrolyzing of the plastic to remove at least some chlorides from the pyrolysis oil by adsorption of the chlorides onto the char and thereby form a purified pyrolysis oil and used char;

separating the used char from the purified pyrolysis oil; and cracking the purified pyrolysis oil to produce one or more olefins.

9. The method of claim 8, wherein at least 20 wt. % of chlorides in the pyrolysis oil is removed to form the purified pyrolysis oil, wherein nitrogen and oxygen content of the pyrolysis oil is not substantially impacted by the mixing with the char.

10. The method of claim 8, wherein the separating is carried out by one or more of the following: decantation, centrifugation, cartridge filtration, and hydrocycloning.

11. The method of claim 8, further comprising:

heating the used char in the pyrolysis reactor for decontamination and drying.

12. The method of claim 8, wherein the mixing is carried out by one or more of the following: a spin contactor, a fluidized bed tank reactor, and a stirred tank reactor.

13. The method of claim 8, wherein the mixing is carried out in a tank where the temperature within the tank is 10 to 30° C.

14. The method of claim 13, wherein the pressure within the tank is in a range of 0.5 to 5 bar.

15. The method of claim 1, wherein the mixing is carried out by a spin contactor.

16. The method of claim 9, wherein the mixing is carried out in a tank where the temperature within the tank is 10 to 30° C.

17. The method of claim 10, wherein the mixing is carried out in a tank where the temperature within the tank is 10 to 30° C.

18. The method of claim 11, wherein the mixing is carried out in a tank where the temperature within the tank is 10 to 30° C.

* * * * *